United States Patent [19]

Kuivalainen et al.

[11] 4,185,356

[45] Jan. 29, 1980

[54] DOOR CLOSER

[75] Inventors: Markku Kuivalainen; Hannu Pehkonen, both of Joensuu, Finland

[73] Assignee: Oy Wartsila Ab, Helsinki, Finland

[21] Appl. No.: 857,667

[22] Filed: Dec. 5, 1977

[30] Foreign Application Priority Data

Dec. 13, 1976 [FI] Finland ..... 763571

[51] Int. Cl.[2] ..... E05F 3/10

[52] U.S. Cl. ..... 16/52; 188/282; 188/284; 188/285; 16/DIG. 20; 16/DIG. 21

[58] Field of Search ..... 16/52, 51, 49, 61, 62, 16/63, DIG. 7, DIG. 9, DIG. 10, DIG. 16, DIG. 17, DIG. 20, DIG. 21; 49/137; 92/10, 11; 188/284, 285, 282, 317, 319, 322

[56] References Cited

U.S. PATENT DOCUMENTS

| | | | |
|---|---|---|---|
| 2,332,520 | 10/1943 | Lucht | 188/285 |
| 3,079,629 | 3/1963 | Millard et al. | 16/52 |
| 3,160,911 | 12/1964 | Morris et al. | 16/52 |
| 3,335,452 | 8/1967 | Patriquin | 16/52 |
| 3,483,585 | 12/1969 | Voster et al. | 16/52 |
| 3,497,904 | 3/1970 | Merayo | 16/52 |
| 3,546,734 | 12/1970 | Pollack et al. | 16/52 |
| 3,574,886 | 4/1971 | Solovieff | 16/52 X |
| 3,616,881 | 11/1971 | Nicholls | 188/284 X |
| 3,656,632 | 4/1972 | Karakashian et al. | 188/317 X |
| 3,797,615 | 3/1974 | Stembridge | 188/285 |
| 4,048,694 | 9/1977 | Newman et al. | 16/52 |

FOREIGN PATENT DOCUMENTS

| | | | |
|---|---|---|---|
| 970400 | 7/1975 | Canada | 16/52 |

*Primary Examiner*—Werner H. Schroeder
*Assistant Examiner*—Moshe I. Cohen
*Attorney, Agent, or Firm*—Haseltine, Lake & Waters

[57] ABSTRACT

A door closer is connected to a door. The movements of the door cause a piston member in the door closer to pump a pressure medium through a flow duct. There is also a flow limiting member influencing at least the speed of the opening movement of the door, and this flow limiting member cooperates with an adjustable activating element which, at a desired opening moment mechanically sets the elements of the flow limiting member in a position considerably increasing the flow resistance of the pressure medium. This brakes the movement of the piston member, and thus, also the movement of the door.

11 Claims, 2 Drawing Figures

DOOR CLOSER

Figure 1:
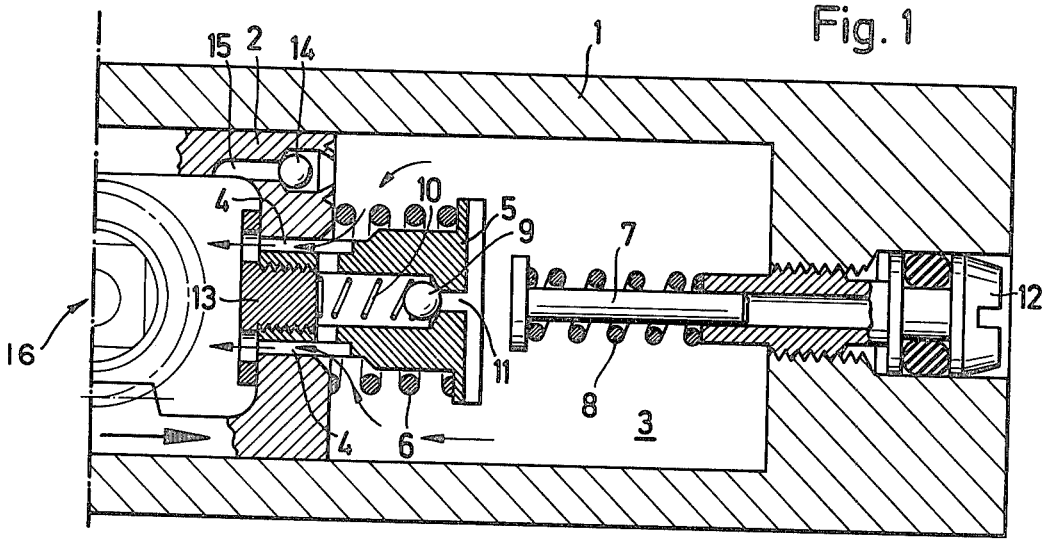

The invention relates to a door closer comprising a movable piston member being influenced by the movements of a door connected to the door closer and including a through-going flow duct, through which the piston member brings pressure medium to flow, and a flow limiting member influencing the speed of the opening movement of the door.

Some hydraulic opening brakes for door closers are known (see for instance Finnish patent application No. 761440, publication print 32024), also of the type where the main flow duct of the door closer is arranged in the piston member (see for instance Swedish publication print No. 358701). In this case, the throttled duct necessary for obtaining the braking effect is usually arranged separately in the body of the door closer, because it is extremely difficult to cause, by hydraulic means, the braking function to start in dependence of the flow of pressure medium in the door closer, using merely a device located in the piston member. On the other hand, a throttled duct, made in the body of the door closer, usually has to be rather long, which brings about that the braking device, as in most known opening brake designs, will be especially sensitive for temperature changes.

One object of the invention is to provide a door closer with an opening brake construction which is more reliable in service and more suitable for use in all kinds of climate than known constructions. The invention is characterized in that said flow limiting member is provided with an adjustable activating element which, in a desired opening phase of the door, is arranged to mechanically set the elements of the flow limiting member in a position considerably increasing the flow resistance of the pressure medium for braking the movement of said piston member, and thus, also the movement of the door. The providing of a mechanical activating element results in a simple construction and a simple principle of function, which secures a reliable function also when great temperature fluctuations occur.

Especially, from consideration of dimensions and model design it is of advantage to arrange the flow limiting elements giving the braking effect in the piston member. The flow limiting member can be provided with a throttled duct which only partly is separate from the main flow duct of the door closer. By this means, a short throttled duct can be arranged, which is favourable when temperature fluctuations are taken into account and which also gives space saving advantages.

The braking function is obtained in a favourable way, if there is, in the flow limiting member, besides the main flow duct with its valve, a preferably spring loaded valve for said throttled duct. Then the mechanical activating element can be arranged to close the main flow duct by operating its valve, thus causing the pressure medium to flow through the valve of the throttled duct.

In order to obtain a simple and effective design the throttled duct can be arranged in the valve body of the valve of the main flow duct. Further, the spring of the valve of the throttled duct can be attached to a holder member which is adjustably attached, for instance by threads, to the valve body of the main flow duct valve, so that the tension of the spring of this valve can be adjusted. By this means, the pressure which gives the braking effect, can be set. The holder member can also act as a member holding the valve body of the main flow duct valve in its proper place during the closing movement of the door.

It is of advantage to provide the valve body of the main flow duct valve with a spring in order to prevent premature closing due to normal flow of pressure medium.

The mechanical activating element is made flexible in the moving direction of the piston member so that it does not form a rigid obstacle for the piston member. The flexibility of the activating element is preferably determined by a spring, the spring modulus of which is greater than the spring modulus of the spring of the main flow duct valve, so that the last mentioned spring will not be able to resist the closing of the main flow duct, and hence, the whole opening brake function.

In order to be able to adjust the activating element in the moving direction of the piston member, the activating element should preferably be connected to an adjustment screw, by means of which the starting point of the opening brake function relatively to the opening angle of the door can be adjusted. This adjustment possibility is very useful because the braking can be effected thereby, for instance, suitably before the door hits a stationary obstacle behind the door, or alternatively, the braking function can be completely turned off.

Figure 2:
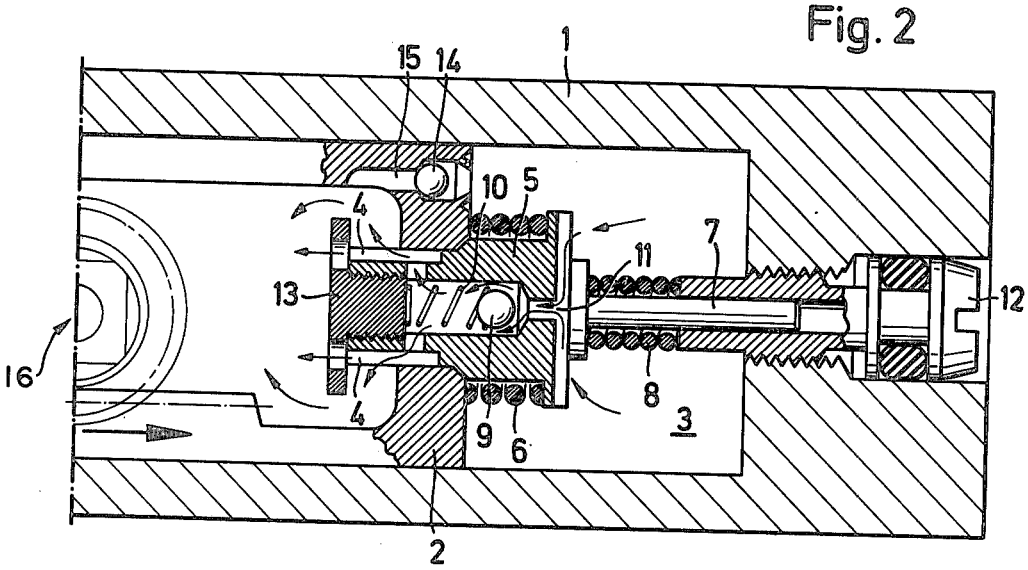

In the following, the invention will be described more in detail with reference to the attached drawing in which FIG. 1 shows a side view section through the opening brake portion of a door closer according to the invention, before the braking phase, and FIG. 2 shows the opening brake of FIG. 1 in its braking phase.

In the drawing, the numeral 1 designates the body of a door closer and 2 a piston member which in a way known per se is, by means of a force transmitting mechanism, for instance, using a rack and pinion mechanism or the like (not shown in the drawing), is arranged to move pressure medium filling a space 3 inside the body of the door closer, in accordance with the movements of a door connected to the door closer. In the piston member 2, there is a ball 14, which allows a flow through the duct 15 only during the closing phase of the door, thereby reducing the flow resistance during this phase.

According to FIG. 1, pressure medium flows freely due to the movement of the piston member 2 through the main flow duct 4 when the door is opened, until the valve body 5 of a valve in the flow duct 4 touches an activating element 7 provided with a spring 8. Since the spring 8 is less flexible than the spring 6 of the valve body 5, the activating element 7 closes, by means of the valve body 5, the valve of the main flow duct 4. Thus, the pressure increases in that part of the space 3 which is at the advancement side of the piston member 2, thereby causing a braking of the movement of the piston member and damping the opening movement of the door.

Power transmission connection 16 to the door is via a rack and pinion mechanism of the type shown in U.S. Pat. No. 3,574,886.

According to FIG. 2, a throttled duct 11 is opened when the braking pressure has increased so much that it overcomes the spring force of the spring 10 of the valve ball 9 of a valve in the throttled duct 11. Nevertheless, there is still an overpressure at the advancement side of the piston member 2, which pressure damps the movement of the piston member until the movement of the door has stopped.

In the shown embodiment, the braking pressure can be set by turning a stop member 13, which is in threaded connection with the valve body 5 which influences the tension of the spring 10, and thereby, through the valve ball 9, influences the opening of the valve of the throttled duct 11. In principle, there is no need for the valve ball 9, but then the throttled duct 11 would have to be very narrow in order to provide sufficiently high braking pressures, which would lead to that the throttled duct would be easily clogged. In addition, the said setting possibility would be lost.

The point of the opening movement, where the braking starts, can be set from the outside of the body 1 of the door closer by means of the adjustment screw 12 connecting activating element 7. In principle, it would also be possible to set the braking pressure from the outside of the body, for instance, by using the activating element 7 as an adjustment element and providing it with a protrusion fitting into a corresponding recess in the valve body 5 or vice versa. This has not been done in the shown embodiment, because the shown application of the setting of the braking phase starting point and range by means of the activating element 7 already per se provides adjustment possibilities which are quite sufficient for practical use.

The shown location of a flow limiting member to the piston member 2 is especially advantageous in a case where the movement of the door is transmitted to the piston member by means of a rack inside the door closer. In this case, the high pressures caused by the braking action will not be able to act on the sealings of the pinion shaft or any corresponding force transmitting element. In addition, the shown construction provides a possibility of using freely the sealing surface of the opposite end of the piston member to control the so called slow closing function, by means of which a slow closing movement is obtained at the beginning of the closing movement.

The invention is not limited to the embodiment shown but several modifications thereof are feasible within the scope of the attached claims.

We claim:

1. A door closer comprising a movable piston member including a main flow duct with a movable valve body; said piston member having a power transmitting connection to a door; a pressure medium and chambers; the movements of said door causing said piston member to pump said pressure medium within said door closer from one of said chambers to another of said chambers through said main flow duct; said piston member further comprising a flow limiting member including a throttled duct and influencing at least the speed of the opening movement of said door; an adjustable activating element; said flow limiting member being arranged to cooperate with said adjustable activating element, said activating element being arranged in a desired opening phase of said door to mechanically move said valve body into a position closing said main flow duct to force said pressure medium to flow through said throttled duct, for substantially increasing the flow resistance of said pressure medium to brake the movement of said piston member and thereby to brake the movement of said door.--

2. A door closer as defined in claim 1, including a spring-loaded valve in said throttled duct; said throttled duct being arranged in the valve body of said main flow duct; a holder member and a first spring for said spring-loaded valve, said first spring being connected with said holder member, said holder member being adjustably connected to said valve body of said main flow duct for allowing adjustment of the tension of said first spring; said valve body having a second spring arranged to prevent premature closing of said main flow duct; said activating elements being flexible in the moving direction of said piston member corresponding to an opening of said door; a third spring connected to said activating element; said third spring determining flexibility of said activating element, the spring modulus of said third spring being greater than the spring modulus of said second spring for keeping said valve body in a position to allow said pressure medium to pass through said main flow duct; said activating element being connected to said adjustment screw for allowing adjustment of said activating element in moving direction of said piston member.--

3. A door closer according to claim 1 wherein said throttled duct is only partly separate from said main flow duct.

4. A door closer according to claim 1 wherein said throttled duct is arranged in the valve body of said main flow duct.

5. A door closer according to claim 1 wherein said throttled duct has a spring loaded valve.

6. A door closer according to claim 5, including a holder member and first spring for said spring-loaded valve said first spring being connected with said holder member, said holder member being adjustably connected to said valve body of said main flow duct for allowing adjustment of the tension of said first spring.

7. A door closer according to claim 6 wherein said holder member also is arranged to hold said valve body in its proper place.

8. A door closer according to claim 1 wherein said valve body has a second spring arranged to prevent premature closing of said main flow duct.

9. A door closer according to claim 1 wherein said activating element is flexible in the moving direction of said piston member corresponding to an opening movement of said door.

10. A door closer according to claim 9, including a third spring connected to said activating element, said third spring determining the flexibility of said activating element, the spring modulus of said third spring being greater than the spring modulus of said second spring for keeping said valve body in a position to allow said pressure medium to pass through said main flow duct.

11. A door closer according to claim 1, including an adjustment screw wherein, said activating element is connected to said adjustment screw for allowing adjustment of said activating element in the moving direction of said piston member.

* * * * *